US008602199B1

(12) United States Patent
Palombi

(10) Patent No.: US 8,602,199 B1
(45) Date of Patent: Dec. 10, 2013

(54) METHOD AND APPARATUS FOR CONTROLLING AND OPERATING A PLURALITY OF ELECTRONIC APPLIANCES

(76) Inventor: Carlo Aldo Palombi, San Rafael, CA (US)

( * ) Notice: Subject to any disclaimer, the term of this patent is extended or adjusted under 35 U.S.C. 154(b) by 0 days.

(21) Appl. No.: 13/194,627

(22) Filed: Jul. 29, 2011

Related U.S. Application Data

(63) Continuation-in-part of application No. 12/418,298, filed on Apr. 3, 2009, now abandoned.

(60) Provisional application No. 61/379,960, filed on Sep. 3, 2010.

(51) Int. Cl.
*G07F 5/18* (2006.01)
*G07F 7/00* (2006.01)

(52) U.S. Cl.
USPC ..... 194/205; 194/350; 235/91 D

(58) Field of Classification Search
USPC ..... 194/202, 204, 205, 350; 235/91 R, 91 D, 235/91 L; 705/16, 17, 418; 700/90, 297, 306
See application file for complete search history.

(56) References Cited

U.S. PATENT DOCUMENTS

| | | | | |
|---|---|---|---|---|
| 2,170,026 | A * | 8/1939 | Kahn | 109/42 |
| 3,076,107 | A * | 1/1963 | Johnston | 307/141.4 |
| 4,665,710 | A * | 5/1987 | Kyzer et al. | 62/155 |
| 4,773,020 | A * | 9/1988 | Anderson et al. | 705/418 |
| 5,345,379 | A * | 9/1994 | Brous et al. | 700/17 |
| 5,450,938 | A * | 9/1995 | Rademacher | 194/206 |
| 5,654,701 | A * | 8/1997 | Liao et al. | 341/22 |
| 5,799,281 | A * | 8/1998 | Login et al. | 705/1.1 |
| 6,321,985 | B1 * | 11/2001 | Kolls | 235/381 |
| 6,346,039 | B2 * | 2/2002 | Orton et al. | 453/3 |
| 6,553,595 | B1 * | 4/2003 | Bruntz et al. | 8/158 |
| 7,016,744 | B2 * | 3/2006 | Howard et al. | 700/83 |
| 7,323,648 | B1 * | 1/2008 | Palombi | 200/52 R |
| 7,325,731 | B2 * | 2/2008 | Tashiro et al. | 235/383 |
| 2004/0035672 | A1 * | 2/2004 | Fletcher et al. | 194/206 |

* cited by examiner

*Primary Examiner* — Mark Beauchaine

(57) ABSTRACT

An apparatus for controlling and operating a plurality of electronic appliances such as self-service laundry machines installed in a commercial coin operated laundry facility. The apparatus includes a controller portion wired directly and independently to the start switches of each of the plurality of laundry machines in the facility. The control apparatus includes means for input of a variety of payment types, at least one laundry machine actuating keypad with keys corresponding to specific individual laundry machines, a coin changer, and means to return change to a customer. Thus, the customer is able to utilize any of the laundry machines with any type of available payment, and coins deposited in the coin input are delivered to the coin changer to replenish the supply of coins.

20 Claims, 1 Drawing Sheet

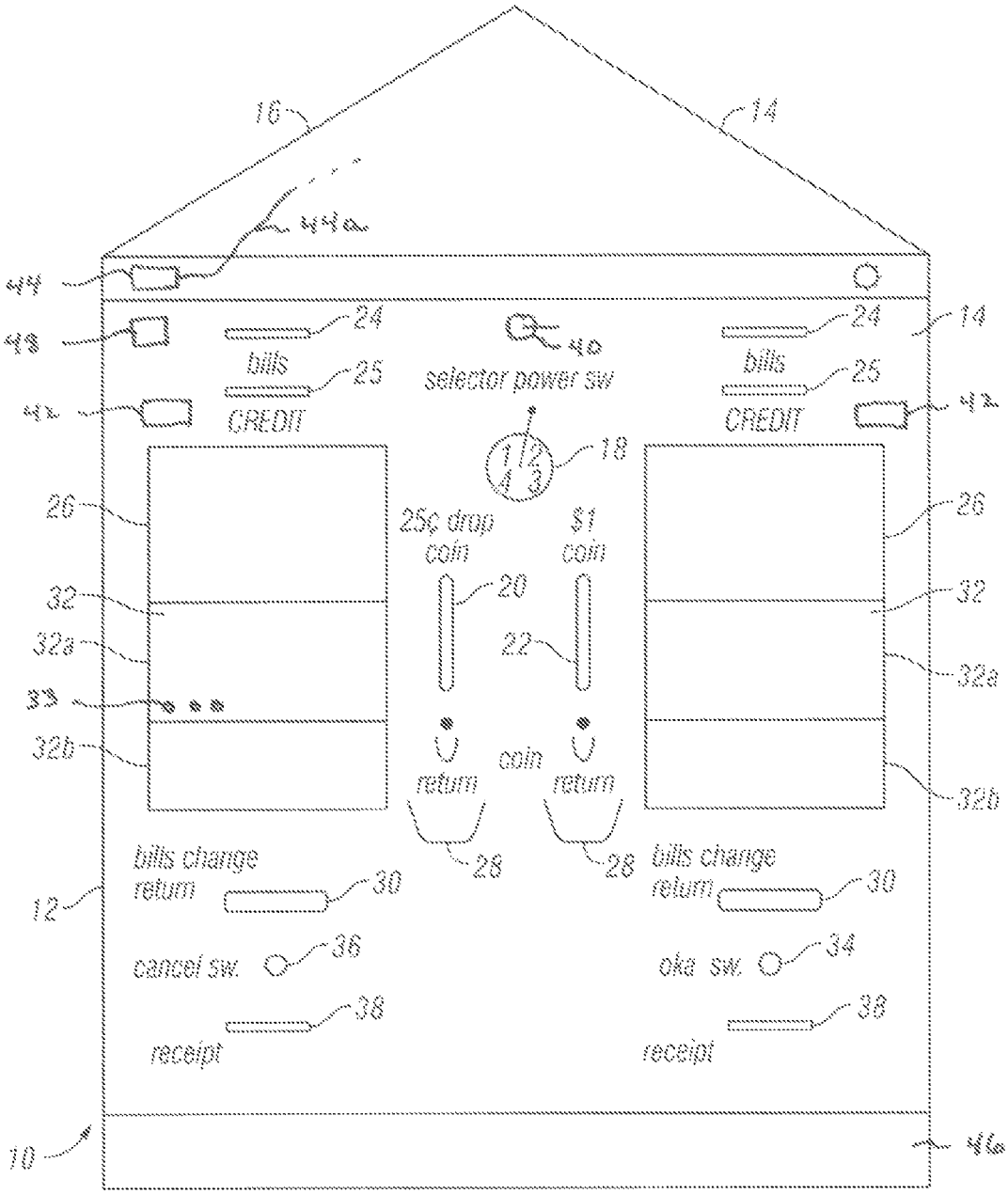
16
14
44a
44
48
24
bills
25
CREDIT
40
selector power sw
42
18
26
25¢ drop coin
$1 coin
20
22
32
32a
32b
coin return
28
bills change return
30
12
cancel sw.
36
38
receipt
10
46

METHOD AND APPARATUS FOR CONTROLLING AND OPERATING A PLURALITY OF ELECTRONIC APPLIANCES

CROSS REFERENCE TO RELATED APPLICATIONS

This application is a continuation-in-part of application Ser. No. 12/418,298 filed Apr. 3, 2009. This application also claims the benefit of Provisional application Ser. No. 61/379,960 filed Sep. 3, 2010.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to electric controls and switches, and more particularly to an improved method and apparatus for controlling and operating a plurality of electronic appliances such as self-service laundry machines installed in a commercial coin operated laundry facility, apartment complex, or the like.

BACKGROUND INFORMATION AND DISCUSSION OF RELATED ART

Commercial coin operated laundry facilities ("laundromats") typically have a dozen or more washing machines and dryers, each with its own coin drop system. However, this arrangement adds cost and complexity to each machine, and renders all of the machines independently susceptible to tampering and theft.

U.S. Pat. No. 4,406,358 to Zahradnik discloses a security guard for protecting the coin receptor unit of a coin operated automatic washing machine, dryer or similar machine embodying a heavy metal cage structure fitted about the coin receptor housing so as to prevent unauthorized removal of the coin box therefrom. The guard is provided with a first sidewall member and a top wall member which are integrally related at right angles to one another. A second sidewall member is hingedly joined to the top wall member and operationally parallels the first sidewall member. A fixed bolt or shaft extends from the inside of the first sidewall member laterally through the coin receptor unit and is received through an opening in the second sidewall member when the latter is swung into operating position. A front wall member of the guard is also hinged to the first sidewall member and is arranged to swing over the front end of the receptor unit, blocking off access to the coin box. The front wall member is provided with an opening for the passage of a hardened steel shaft or bolt which anchors to the front wall member and passes through an opening formed for that purpose near the outer end of the fixed bolt so that the two are thus intersectingly interlocked exteriorly of the receptor and guard in operation. A suitable padlock or other locking means is provided to secure the bolt and shaft in their interlocked relationship, preventing its unauthorized removal.

U.S. Pat. No. 5,386,362 to Keret describes a management system for coin operated laundry machines at individual locations, the system including data transfer means at each machine, a hand held terminal for receiving and transmitting data, in which each machine includes a circuit board interconnecting coin collecting means and operational circuits, the circuit board having storage facilities for both operational parameters and coin auditing data, the hand held terminal having means for transmitting information serving to vary any of the operational parameters and for receiving data associated with coin collection.

U.S. Pat. No. 6,578,398 to Behunin teaches a commercial washer and dryer coin box guard adapted for receipt in a coin box frame. A coin box is slidably received inside the coin box frame, which is part of a coin box housing. The coin box housing is part of a washer or dryer. The coin box guard is designed to prevent unauthorized entry into the coin box and stealing coins found therein. The guard includes a face plate dimensioned for covering the front of the coin box frame. The face plate has one or more flanges on the sides thereof for engaging a portion of the sides of the front of the coin box frame. One of the sides of the coin box frame has a frame hole therethrough. The frame hole in the side is indexed with a flange hole in one of the flanges. The frame holes in the side of the coin box frame and the flange are adapted for receiving a hasp of a padlock for securing the face plate to the front of the coin box frame. Also, the sides of the coin box frame can have a pair of frame holes indexed with a pair of flange holes for receiving a lock bolt therethrough. The lock bolt, using a padlock, holds the face plate next to the front of the coin box frame.

U.S. Pat. No. 7,418,521 to Schroeder, et al. discloses a controller for bridging a host computer and networked laundry machines. A laundry system has a plurality of laundry machines networked together and a remotely located host computer for collecting operation data and audit data from the laundry machines and to program the laundry machines with operation parameters. A bridging controller is provided to bridge the host computer with the network of laundry machines, and communicates with the host computer through a wired or wireless network connection. The host computer may command the bridging controller to collect data from the laundry machines and may send programming data to the laundry machines through the bridging controller.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved method and apparatus for controlling and operating a plurality of electronic appliances such as self-service laundry machines installed in a commercial coin operated laundry facility, apartment complex, or the like. The inventive apparatus includes a controller portion wired directly and independently to the start switches of each of the plurality of laundry machines in the facility (e.g., all of the washers and all of the dryers). The control apparatus may include means for input of a variety of payment types (including coin drops and/or coin slides for quarters, and tokens, a paper currency input, a credit card reader, and/or a voucher input); and at least one laundry machine actuating switch or keypad with switch positions or keys corresponding to the specific individual laundry machines (e.g., ten positions for ten machines). Thus, the user may be able to utilize any of the available laundry machines with any type of payment, and choose alternate payment types if one type is temporarily inoperable.

In a first embodiment, the apparatus may include a multi-position rotary-type switch with at least two separate and independent electric lines to each of the laundry machines, to prolong the operational life of the inventive apparatus (i.e., if one of the lines fails, the apparatus would still be able to function). The multi-position switch may be used to select any of the plurality of laundry machines.

The coins and paper currency modes preferably also include at least one keypad to specify the monetary amount to be utilized from the amount tendered, and corresponding coin and change returns. These keypads may include keys for 25 cents, 50 cents, 75 cents, 1 dollar, 2 dollars, 3 dollars, 4 dollars, and 5 dollars, or any other amount suitable to select the requisite payment for a selected laundry machine and time of operation. The optional credit card mode preferably also includes a keypad to specify the monetary amount to be charged to the credit card.

Once payment has been inserted and accepted by the system, the user selects the specific laundry machine to be activated by rotating the switch to correspond to the desired laundry machine. Once a particular machine or machines have been selected by the customer by the switch, indicator lights may indicate the selected machines, and those lights may remain illuminated for the duration of the cycles of the machines that were selected, so that subsequent customers will be directed to machines that are not in use. Also, the indicator lights may remain continuously on for machines that are out of order.

The inventive apparatus also provides a means to control the usage of coins used to operate the laundry machines, effectively operating as a cash register. The apparatus may be mounted on top of a coin changer, of the type where a customer can insert paper currency and receive coins or tokens, delivering the coins that are deposited in the control apparatus directly to the coin changer through a channel or wire pipe to replenish the coin supply in the coin changer. Most or all of the change that is dispensed from the coin changer is thus immediately recirculated through the apparatus and back into the coin changer, thereby reducing the amount of coins needed to be kept in the system, and eliminating the one-way flow of coins from a coin changer to the coin drops in each individual machine, such as is found in a traditional laundry facility. Alternatively, the apparatus may be mounted on top of a safe so that money inserted into the apparatus is immediately deposited into the safe for secure storage of the money.

In a second embodiment, the apparatus includes two coin slides or coin drop units, one multi-position rotating switch for machine selection, two security cover locks, and an internal security safe with a combination lock. This embodiment is particularly suitable for apartment complexes and similar facilities, and helps to reduce fraud and theft.

The inventive apparatus may include two or more coin slides or coin drops connected in series to enable longer operating time. The components (e.g., switches) of the apparatus that actually control the laundry machines operate through the laundry machine start circuits and thus do not require independent electrical power. Thus, the apparatus may be configured to operate without the need for electrical power, e.g., even if the accompanying coin changer goes out of order, the control apparatus will continue to work and the laundry machines can be utilized. The apparatus works with all types of machines, new or used, commercial or domestic.

The coin or token drops utilized with the apparatus may include antitheft features such as the double action activated switch disclosed in U.S. Pat. No. 7,323,648 by applicant herein.

A variety of other security features may be included with the apparatus. For example, the apparatus itself may incorporate one or more mechanical locks, electronic security locks, audible security alarms, power and low battery alarms, heat and smoke detectors, and the like. In one embodiment, the alarm system may be in the form of a tilt detector or wire connected to the housing or the anti-theft switch, wherein if the apparatus is tilted or the wire is cut, the alarm is activated. The wire may also be connected to at least some portion of the laundry facility structure itself, to provide a security alarm for the laundry facility.

The method and apparatus of this invention may also be used to operate other electric appliances and devices including, but not limited to, arcade games, casino games, vending machines, ticket purchase machines, fast food purchase machines, and the like. The apparatus may optionally include a printer to print paper receipts for the item or service that was purchased.

It is therefore an object of the present invention to provide a new and improved method for controlling and operating a plurality of electronic appliances.

It is another object of the present invention to provide a new and improved apparatus for controlling and operating a plurality of self-service laundry machines.

A further object or feature of the present invention is a new and improved apparatus for controlling and operating a plurality of self-service laundry machines which includes a controller portion wired directly and independently to the start switches of each of the plurality of laundry machines in the facility.

An even further object of the present invention is to provide a novel method and apparatus for controlling and operating a plurality of self-service laundry machines which includes means for input of a variety of payment types.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic view of an apparatus for controlling and operating a plurality of electronic appliances of this invention.

DETAILED DESCRIPTION OF THE INVENTION

Referring to FIG. 1, there is illustrated therein a new and improved apparatus for controlling and operating a plurality of electronic appliances such as self-service laundry machines, generally denominated 10 herein. The apparatus is preferably constructed in the form of a triangle shaped kiosk 12, with two customer operation panels 14 and one service access panel 16, to save space and facilitate fast service and enhanced security.

Each customer operation panel 14 preferably includes a four-way rotary-type switch 18 with at least two separate electric lines wired directly and independently to the start switches of each of the plurality of laundry machines in the facility (e.g., all of the washers and all of the dryers), to prolong the operational life of the inventive apparatus (i.e., if one of the lines fails, the apparatus would still function). The four-way switch is used to select the desired payment type in order to activate any of the plurality of laundry machines. The switch positions may include 1) coins (e.g., quarters and dollar coins); 2) paper currency (any denomination); 3) "off"; and optionally 4) credit card (e.g., Visa and MasterCard). Coins or tokens may be inserted in 25 cent coin slide mechanism or coin drop 20 or dollar coin slide mechanism or coin drop 22, while bills may be inserted at bill readers 24, and optionally, credit cards or vouchers may be swiped or read at reader 25. The paper currency mode preferably also includes at least one or a plurality of keypads 26 to specify the monetary amount to be utilized from the amount tendered, and corresponding pairs of coin returns 28 and change returns 30. The keypads 26 may include keys for 25 cents, 50 cents, 75 cents, 1 dollar, 2 dollars, 3 dollars, 4 dollars, and 5 dollars, or any other amount suitable to select the requisite payment for a selected laundry machine and time of operation. The keypads may also bear different price denominations, so that the keypads can be used independently, or together to add one denomination to another to obtain any combination of prices. The optional credit card mode preferably also utilizes this or another keypad to specify the monetary amount to be charged to the credit card.

Once payment has been inserted and accepted, the user selects the specific laundry machine to be activated by pressing the keys on one or a pair of machine selection keypads 32 (e.g., one numeric keypad 32*a* for washing machines, and one alpha keypad 32*b* for dryers) corresponding to the desired laundry machines. In the preferred embodiment, the apparatus should have two separate sets of electrical control key pads for redundancy in case of failure of the first set. One or more confirm keys 34 may be used to enter a selection, and one or more cancel keys 36 used to cancel a selection.

Indicator lights 33 in the keys preferably illuminate the keys selected by a customer, and those keys remain illuminated for the duration of the cycles of the machines that were selected. In addition, keypad indicator lights remain constantly on for laundry machines that are out of service.

The apparatus may optionally include one or more printers 38 to print paper receipts for the item or service that was purchased. A power line switch 40 ensures that only one of the two circuits (e.g., left or right) is activated at a time. A coin or register counter 42 displays the amount of money that has been used. An alarm 44 may be activated upon any attempted breach of the system.

The apparatus is preferably mounted on top of a coin changer 46, delivering the coins that are deposited in the apparatus through a channel or wire pipe directly to the coin changer to replenish the coin supply in the coin changer. Any change that is dispensed from the coin changer is thus immediately replaced, thereby reducing the amount of coins needed to be kept in the system, and eliminating the one-way flow of coins from a coin changer to the coin drops in each individual machine, such as found in a traditional laundry facility. This arrangement may also be used for tokens instead of or in addition to coins. Alternatively, the apparatus may be mounted on top of a safe instead of a coin changer so that money inserted into the apparatus is immediately deposited into the safe for secure storage of the money.

The two or more coin slides or coin drops may be connected in series to enable longer operating time. The apparatus may be configured to operate without the need for independent electrical power, e.g., even if the coin changer loses power and goes out of order, the control apparatus will continue to accept at least some forms of payment and the laundry machines can still be utilized. The apparatus may also include at least one supplemental switch and wire harness for connection to later-installed appliances.

The apparatus itself may incorporate one or more mechanical locks or electronic security locks 48. Alarm 44 may include power and backup battery alarms, low battery alarms, heat and smoke detectors, and the like. The alarm system may be in the form of a wire 44*a* connected to the housing or the anti-theft switch, wherein if the apparatus is tilted or the wire is cut, the alarm is activated. This arrangement may require only three parts: a smoke detector/alarm, an anti-theft coin switch, and a balanced weight. The wire or actuator arm of the anti-theft coin switch may also be attached to a wall surface of the housing, such that the alarm is activated if the wall surface is cut. The wire may also be connected to at least some portion of the laundry facility structure itself, to provide a security alarm for the entire laundry facility.

The alarm system may also be configured with a smoke detector/alarm, anti-theft coin switch, key security lock, metal strike, and electrical wires as follows. The anti-theft coin switch wires are connected in a normal closed position. The security lock has a strike with a 90 degree swing to open or close the lock, with one actuator arm of the switch located under the metal strike of the security lock in closed position. The other actuator arm is located in the open position of the security lock. If the lock is drilled out, the metal strike will fall, closing the electric circuit and sounding the alarm.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An apparatus for controlling and operating a plurality of self-service laundry machines, said apparatus comprising:

a controller portion wired directly and independently to the start switches of each of the plurality of laundry machines, wherein said controller portion is mechanical and does not require electrical power to start the plurality of laundry machines;

means for input of a variety of payment types including at least one coin input;

switch means to select the desired payment type;

at least one laundry machine actuating keypad with keys corresponding to specific individual laundry machines;

a coin changer connected to said at least one coin input, said coin changer including a supply of coins; and means to return change to a customer, wherein a user is able to utilize any of the laundry machines with any type of available payment, and receive change from the amount tendered, and coins deposited in said at least one coin input are delivered to said coin changer to replenish said supply of coins in said coin changer.

2. The apparatus for controlling and operating a plurality of self-service laundry machines of claim 1 wherein said means for input of a variety of payment types comprises a means for input selected from the group consisting of a coin drop, a coin slide, a paper currency input, a credit card reader, a voucher reader, and a token input.

3. The apparatus for controlling and operating a plurality of self-service laundry machines of claim 2 wherein said means for input of a variety of payment types comprises a plurality of coin inputs connected in series to enable longer operating time.

4. The apparatus for controlling and operating a plurality of self-service laundry machines of claim 1 wherein said means for input of a variety of payment types comprises an anti-theft switch for coins.

5. The apparatus for controlling and operating a plurality of self-service laundry machines of claim 4 wherein said anti-theft switch is connected to an alarm.

6. The apparatus for controlling and operating a plurality of self-service laundry machines of claim 5 including a wire connected to said anti-theft switch, wherein if the apparatus is tilted or said wire is cut, said anti-theft switch closes a circuit and activates said alarm.

7. The apparatus for controlling and operating a plurality of self-service laundry machines of claim 6 wherein said wire is attached to a wall surface, such that said alarm is activated if the wall surface is cut.

8. The apparatus for controlling and operating a plurality of self-service laundry machines of claim 6 wherein said wire is connected to at least some portion of the laundry facility structure to provide a security alarm for the laundry facility.

9. The apparatus for controlling and operating a plurality of self-service laundry machines of claim 1 including at least one of an electronic security lock, a power alarm, a backup battery alarm, a smoke detector, and a heat detector.

10. The apparatus for controlling and operating a plurality of self-service laundry machines of claim 1 wherein said apparatus is mechanical and operates without independent electrical power.

11. The apparatus for controlling and operating a plurality of self-service laundry machines of claim 1 wherein said controller portion includes a rotary switch with at least two separate electric lines to the laundry machines.

12. The apparatus for controlling and operating a plurality of self-service laundry machines of claim 1 wherein said apparatus includes at least one supplemental switch and wire harness for connection to later-installed appliances.

13. The apparatus for controlling and operating a plurality of self-service laundry machines of claim 1 further including at least one keypad to specify the monetary amount to be utilized from the amount tendered.

14. The apparatus for controlling and operating a plurality of self-service laundry machines of claim 1 further including coin and bill change returns.

15. The apparatus for controlling and operating a plurality of self-service laundry machines of claim 1 further including a pair of keypads corresponding to the desired laundry machine.

16. The apparatus for controlling and operating a plurality of self-service laundry machines of claim 1 further including two separate sets of electrical control key pads for redundancy in case of failure of the first set.

17. The apparatus for controlling and operating a plurality of self-service laundry machines of claim 1 further including a safe for receipt and storage of coins and currency.

18. The apparatus for controlling and operating a plurality of self-service laundry machines of claim 1 wherein said coin input includes a coin counter.

19. The apparatus for controlling and operating a plurality of self-service laundry machines of claim 1 further including indicator lights to indicate the selected machines, wherein said indicator lights remain illuminated for the duration of the cycles of the machines that were selected.

20. The apparatus for controlling and operating a plurality of self-service laundry machines of claim 1 further including indicator lights that remain constantly on to indicate inoperative laundry machines.

* * * * *